United States Patent [19]

Hegg et al.

[11] Patent Number: 4,548,155

[45] Date of Patent: Oct. 22, 1985

[54] BOAT INCLUDING SWIM PLATFORM

[75] Inventors: Allan B. Hegg, Manistee; James S. Phares, Farmington Hills, both of Mich.

[73] Assignee: Century Boat Company, Manistee, Mich.

[21] Appl. No.: 642,551

[22] Filed: Aug. 20, 1984

[51] Int. Cl.[4] ..... B63B 17/00

[52] U.S. Cl. ..... 114/362; D12/300

[58] Field of Search ..... 114/253, 343, 357, 362, 114/364; 441/68; D12/300, 314, 317

[56] References Cited

U.S. PATENT DOCUMENTS

| | | | |
|---|---|---|---|
| D. 190,065 | 4/1961 | Currie | D12/300 |
| D. 246,234 | 11/1977 | Whitley et al. | D12/314 |
| 3,613,137 | 10/1971 | Eccles | 114/362 |
| 3,790,977 | 2/1974 | Bombardier et al. | 114/357 |

OTHER PUBLICATIONS

Century, Trailer Boats, Jun. 1983, p. 20.

U.S. patent application Ser. No. 536,858, filed Sep. 28, 1983, by Allan B. Hegg et al., entitled Boat.

*Primary Examiner*—Trygve M. Blix

*Assistant Examiner*—Stephen P. Avila

*Attorney, Agent, or Firm*—Price, Heneveld, Huizenga & Cooper

[57] ABSTRACT

The specification discloses a ski boat having a swim platform across which a conventional water ski can be laid so that a skier can easily put the ski on while standing on the platform. More particularly the boat includes a pair of sidewalls and a swim platform integral with and extending between the sidewalls. The swim platform extends rearwardly beyond the sidewalls to provide a portion across which the ski can lie.

1 Claim, 4 Drawing Figures

BOAT INCLUDING SWIM PLATFORM

BACKGROUND OF THE INVENTION

The present invention relates to boats, and more particularly to swim platforms for boats.

A wide variety of swim platforms are available on boats. Typically, the platforms are mounted on the transom and project rearwardly from the boat slightly above water level to facilitate entering and exiting the boat from the water. Additionally, water-skiers often use the swim platform as a staging area prior to entering the water for skiing.

One particularly attractive and functional swim platform is illustrated in U.S. patent application Ser. No. 536,858, filed Sept. 28, 1983, by Hegg et al, and entitled BOAT. This construction includes a pair of boat sidewalls and a swim platform integral with and extending directly between the sidewalls. However, the distance between the sidewalls is shorter than the length of a conventional water ski, and consequently a water ski cannot be laid across the platform. A water-skier must therefore enter the water before fitting his ski or skis.

SUMMARY OF THE INVENTION

The aforementioned problems are overcome in the present invention, wherein a boat includes a swim platform across which a water ski can be laid either for temporary storage or to enable a skier to put on the ski while standing on the platform. More particularly, the boat includes a pair of sidewalls each terminating in a rear edge and a swim platform integral with and extending between the sidewalls. The platform includes an aft portion extending rearwardly from a line drawn between the junctions of the rear sidewall edges and the swim platform. The surface area of this aft portion is sufficient to support a conventional water ski.

The present structure permitting a ski to be laid across the platform enables a skier to fit the binding on his foot prior to entering the water. This is particularly desirable when adjustments to the binding are required for sizing the ski. Such adjustments are more easily performed on the platform than in the water.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
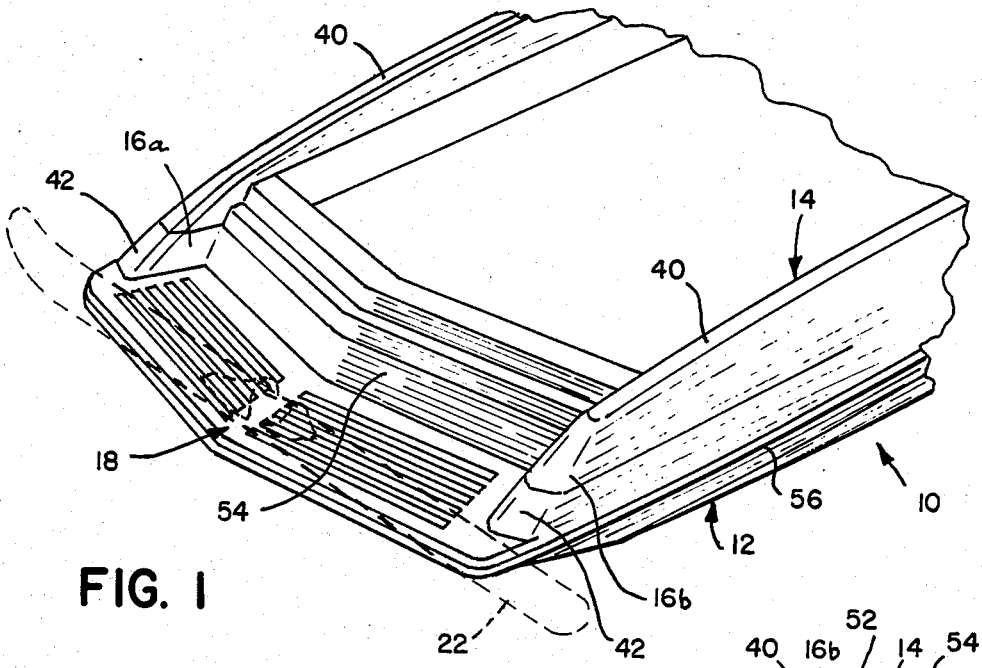
FIG. 1 is a fragmentary perspective view of a boat incorporating the swim platform of the present invention.

A boat constructed in accordance with a preferred embodiment of the invention is illustrated in the drawings and generally designated 10. Boat 10 includes a one-piece hull shell 12 and a one-piece body shell 4 mounted thereon. Body shell 14 includes a pair of spaced sidewalls 16*a* and 16*b* and swim platform 18 integral with and extending therebetween. Swim platform 18 includes an aft portion 18*b* (FIG. 2) extending rearwardly beyond sidewalls 16*a* and 16*b* a sufficient distance and width to support a ski 22 (see also FIG. 1).

Lower hull shell 12 and upper body shell 14 are fabricated of gel-coat and fiberglass using techniques generally well known in the art. Both of shells 12 and 14 are one-piece constructions extending the full length and width of the boat. The forward portion of the boat not visible in the drawings is substantially the same in appearance and construction as the boat illustrated in said U.S. patent application Ser. No. 536,858.

Hull shell 12 (FIGS. 3 and 4) includes running surface 30, splash surface 32, and sidewall 34 extending therebetween. Hull shell 12 is substantially identical in configuration to the hull illustrated in said U.S. patent application Ser. No. 536,858 and in U.S. patent application Ser. No. 536,716, filed Sept. 28, 1983, by Hegg et al, and entitled BOAT HULL. Support wall 36 extends about the transom of the boat between opposite splash surfaces 32, and rear hull wall 38 extends between support wall 36 and running surface 30. Support wall 36 extends upwardly from the remainder of hull shell 12 to support swim platform 18. Strut 35, propeller 37, and rudder 39 are all mounted on boat 10 below hull shell 12 using conventional techniques.

Body shell 14 (FIGS. 1–4) includes a pair of spaced sidewalls 16*a* and 16*b* and swim platform 18 extending therebetween. Each of a sidewall 16 includes upper gunwale edge 40 and rear edge 42 extending downwardly and rearwardly therefrom. Each of the rear edges 42 meets swim platform 18 at a junction point 44, and imaginary line 46 interconnects these junction points.

Figure 3:
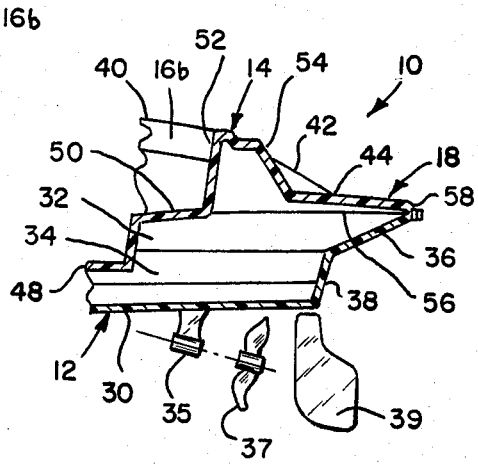
FIG. 3 is a sectional view taken along plane III—III in FIG. 2.

Upper body portion 14 also includes floor 48, seat 50, backrest 52, and stepped wall 54 all of which are integral with and extend between sidewalls 16*a* and 16*b* (FIG. 3). Upper and lower shells 12 and 14 are intersecured about their peripheral edges 56 (FIGS. 1 and 3–4) using well-known techniques.

Figure 2:
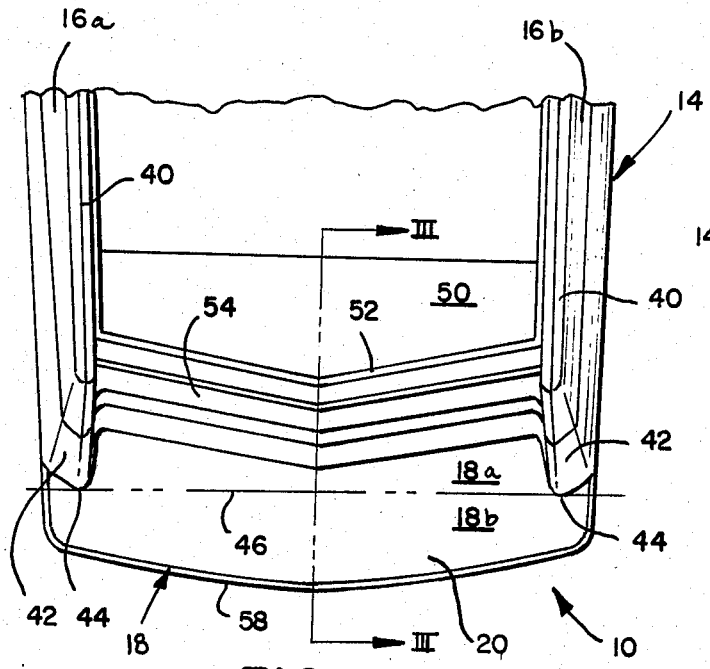
FIG. 2 is a fragmentary top plan view of the boat and swim platform.
Figure 4:
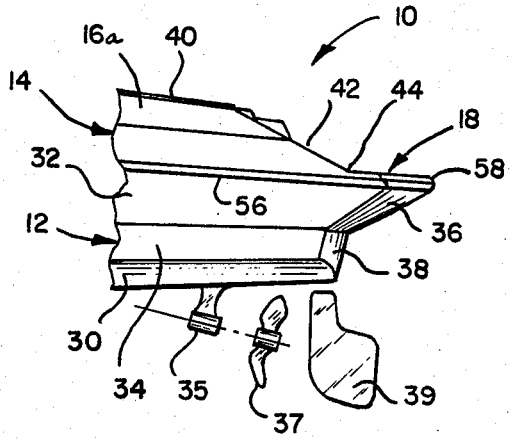
FIG. 4 is a side elevational view of the boat and swim platform.

Swim platform 18 is a generally planar surface integral with stepped face 54 and both of sidewalls 16*a* and 16*b*. Platform 18 includes a rear edge 58 located opposite stepped face 54. Support portion 36 of hull shell 12 supports swim platform 18 along rear edge 58 (FIGS. 3 and 4). Imaginary line 46 interconnecting junction points 44 divides swim platform 18 into a fore portion 18*a* and an aft portion 18*b* (FIG. 2). Fore portion 18*a* extends directly between sidewalls 16, while aft portion 18*b* extends rearwardly beyond rear edges 42 of sidewalls 16. Aft portion 18*b* is of sufficient length and width to support a conventional water ski thereon with at least one end extending beyond one of sidewalls 16 (see also FIG. 1).

A water-skier can easily put on a water ski while standing on the present swim platform. The water-skier can try the binding for size. If the size is proper, the water-skier simply enters the water with the ski on. If the size is not correct, the water-skier adjusts the binding before entering the water. Additionally, the ski can be placed on the swim platform for temporary storage while changing skiers or making adjustments to ski vests, ski ropes, etc.

The above description is that of a preferred embodiment of the invention. Various alternations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A one-piece upper shell for a ski boat comprising: a pair of sidewalls each including a rear edge; and a swim platform at the stern of said boat integral with and extending between said sidewalls, said swim platform including a rear edge, said sidewall rear edges meeting said swim platform forwardly of said swim platform rear edge a distance at least approximately equal to the width of a conventional water ski, said swim platform including an aft portion extending rearwardly from a straight line drawn between the junctions of said sidewall rear edges and said swim platform, whereby said aft portion can support a conventional water ski extending beyond one of said sidewalls.

* * * * *